US009096399B2

(12) United States Patent
Umemoto et al.

(10) Patent No.: US 9,096,399 B2
(45) Date of Patent: Aug. 4, 2015

(54) SHEET FEEDING DEVICE AND IMAGE FORMING APPARATUS

(71) Applicant: KONICA MINOLTA, INC., Chiyoda-ku (JP)

(72) Inventors: Hiroaki Umemoto, Neyagawa (JP); Noboru Oomoto, Toyokawa (JP); Atsuhiko Shimoyama, Tahara (JP); Hiroshi Mizuno, Aisai (JP); Ryo Oshima, Anjo (JP)

(73) Assignee: KONICA MINOLT, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/144,782

(22) Filed: Dec. 31, 2013

(65) Prior Publication Data

US 2014/0191461 A1 Jul. 10, 2014

(30) Foreign Application Priority Data

Jan. 10, 2013 (JP) ..... 2013-002313

(51) Int. Cl.
*B65H 3/48* (2006.01)
*B65H 3/12* (2006.01)
(Continued)

(52) U.S. Cl.
CPC ..... *B65H 3/128* (2013.01); *B65H 3/48* (2013.01); *B65H 7/02* (2013.01); *B65H 2404/264* (2013.01); *B65H 2405/15* (2013.01); *B65H 2405/312* (2013.01); *B65H 2405/332* (2013.01);
(Continued)

(58) Field of Classification Search
CPC ..... B65H 3/48; B65H 3/128
USPC ..... 271/97, 98, 96
See application file for complete search history.

(56) References Cited

U.S. PATENT DOCUMENTS 7,850,162 B2 * 12/2010 Imai et al. ..... 271/31
8,011,652 B2 * 9/2011 Tsukamoto et al. ..... 271/97
(Continued)

FOREIGN PATENT DOCUMENTS

| | | | |
|---|---|---|---|
| JP | 07-144826 | A | 6/1995 |
| JP | 2004-142881 | A | 5/2004 |
| JP | 2005-104723 | A | 4/2005 |
| JP | 2008-150182 | A | 7/2008 |
| JP | 2010-254462 | A | 11/2010 |

OTHER PUBLICATIONS

Office Action (Notification of Reasons for Rejection) issued on Jan. 13, 2015, by the Japanese Patent Office in corresponding Japanese Application No. 2013-002313, and an English translation of the Office Action. (25 pages).

*Primary Examiner* — Luis A Gonzalez
(74) *Attorney, Agent, or Firm* — Buchanan Ingersoll & Rooney PC

(57) ABSTRACT

A sheet feeding device having: a blowing device configured to blow air toward the stack of sheets placed in a predetermined stacking direction, thereby floating at least a top sheet from the stack; a suction/transportation mechanism that includes a suction belt provided above the mounting portion and configured to attract the top sheet floated by the blowing device to transport the attracted sheet in a predetermined transportation direction; and an image pickup device configured to capture images of the top sheet and the next sheet therebelow, and disposed so as to see through an area where a side of the top sheet and the suction belt, when viewed in a plan view in the stacking direction, are close to each other during the floating of the top sheet, to such an extent that the side of the top sheet essentially does not hang downward.

16 Claims, 12 Drawing Sheets

(51) Int. Cl.
*B65H 3/08* (2006.01)
*B65H 7/02* (2006.01)

(52) U.S. Cl.
CPC ... *B65H 2406/362* (2013.01); *B65H 2406/3662* (2013.01); *B65H 2511/22* (2013.01); *B65H 2515/212* (2013.01); *B65H 2553/42* (2013.01); *B65H 2701/1311* (2013.01); *B65H 2801/06* (2013.01)

(56) References Cited

U.S. PATENT DOCUMENTS

| | | | | |
|---|---|---|---|---|
| 8,336,870 | B2 * | 12/2012 | Kobayashi | 271/10.01 |
| 2008/0143037 | A1 | 6/2008 | Imai et al. | |
| 2009/0243194 | A1 | 10/2009 | Gibson et al. | |
| 2014/0265105 | A1 * | 9/2014 | Shimoyama et al. | 271/12 |
| 2015/0021848 | A1 * | 1/2015 | Mizuno et al. | 271/12 |
| 2015/0029525 | A1 * | 1/2015 | Shimoyama et al. | 358/1.12 |

* cited by examiner

SHEET FEEDING DEVICE AND IMAGE FORMING APPARATUS

This application is based on Japanese Patent Application No. 2013-002313, filed on Jan. 10, 2013, the content of which is incorporated herein by reference.

BACKGROUND OF THE INVENTION

1. Field of the Invention

The present invention relates to a sheet feeding device that pneumatically float sheets to be picked up one by one from a sheet stack, and also relates to an image forming apparatus including the sheet feeding device.

2. Description of Related Art

Some image forming apparatuses include sheet feeding devices as described above, in order to feed sheets (e.g., paper) to imaging units (e.g., see Japanese Patent Laid-Open Publication No. 2010-254462). The sheet feeding device 100 disclosed in Japanese Patent Laid-Open Publication No. 2010-254462, will be described in detail below with reference to FIG. 13.

The sheet feeding device 100 includes a blowing device 102 that blows air toward the top edge of a stack of sheets S (on the positive side in the z-axis direction), thereby floating the top sheet S1. Endless suction belts 104 with a number of through-holes provided therein are disposed above the stack of sheets S. By means of an internal fan provided in a chamber (not shown) positioned inside relative to the suction belts 104, the top sheet S1 is attracted to the suction belts 104 by drawing air between the stack of sheets S and the suction belts 104 into the chamber via the through-holes. The suction belts 104 are rotated by a drive force from a motor (not shown). Accordingly, the attracted sheet is carried in the x-axis direction to a receiving port 108 of a transportation path 106. Thereafter, the top sheet S1 is carried through the transportation path 106 to an imaging unit (not shown).

The sheet feeding device 100 further includes an image pickup device 110 and a control circuit 112. The image pickup device 110 captures images of the floated top sheet S1 and another sheet immediately therebelow, from a predetermined distance in the y-axis direction relative to one side P1 of the stack of sheets S. The control circuit 112 calculates the gap between the sheets on the basis of the images captured by the image pickup device 110. Moreover, the control circuit 112 adjusts the volume of air from the blowing device 102 on the basis of the calculated gap between the sheets.

However, in the case of the configuration in FIG. 13, when viewed in a plan view in the z-axis direction, a sheet edge portion near the side P1 might be distanced significantly from the edge of the suction belt 104 on the positive side in the y-axis direction. In such a case, the sheet is not attracted sufficiently to the suction belt 104, so that the sheet edge portion near the side P1 hangs downward. As a result of the edge portion hanging downward, an image of the top sheet S1 is captured with the edge portion near the side P1 overlapping with the sheet therebelow. Accordingly, the control circuit 112 fails to calculate the gap between the sheets accurately.

SUMMARY OF THE INVENTION

A sheet feeding device according to a first aspect of the present invention includes: a mounting portion capable of accommodating a stack of sheets placed in a predetermined stacking direction; a blowing device configured to blow air toward the stack of sheets placed in the mounting portion, thereby floating at least a top sheet from the stack; a suction/transportation mechanism that includes a suction belt provided above the mounting portion and configured to attract the top sheet floated by the blowing device to transport the attracted sheet in a predetermined transportation direction; and an image pickup device configured to capture images of the top sheet and the next sheet therebelow, and disposed so as to see through an area where a side of the top sheet and the suction belt, when viewed in a plan view in the stacking direction, are close to each other during the floating of the top sheet, to such an extent that the side of the top sheet essentially does not hang downward.

A sheet feeding device according to a second aspect of the present invention includes: a mounting portion capable of accommodating a stack of sheets placed in a predetermined stacking direction; a blowing device configured to blow air toward the stack of sheets placed in the mounting portion, thereby floating at least a top sheet from the stack; a suction/transportation mechanism that includes a suction belt provided above the mounting portion and configured to attract the top sheet floated by the blowing device to transport the attracted sheet in a predetermined transportation direction; a reflective member disposed so as to face an area where a side of the top sheet and the suction belt, when viewed in a plan view in the stacking direction, are close to each other during the floating of the top sheet, to such an extent that the side of the top sheet essentially does not hang downward; and an image pickup device configured to capture images of the top sheet and the next sheet therebelow reflected in the reflective member.

An image forming apparatus according to a third aspect of the present invention includes a sheet feeding device of the first aspect.

An image forming apparatus according to a fourth aspect of the present invention includes a sheet feeding device of the second aspect.

DETAILED DESCRIPTION OF THE PREFERRED EMBODIMENTS

Embodiment

Figure 1:
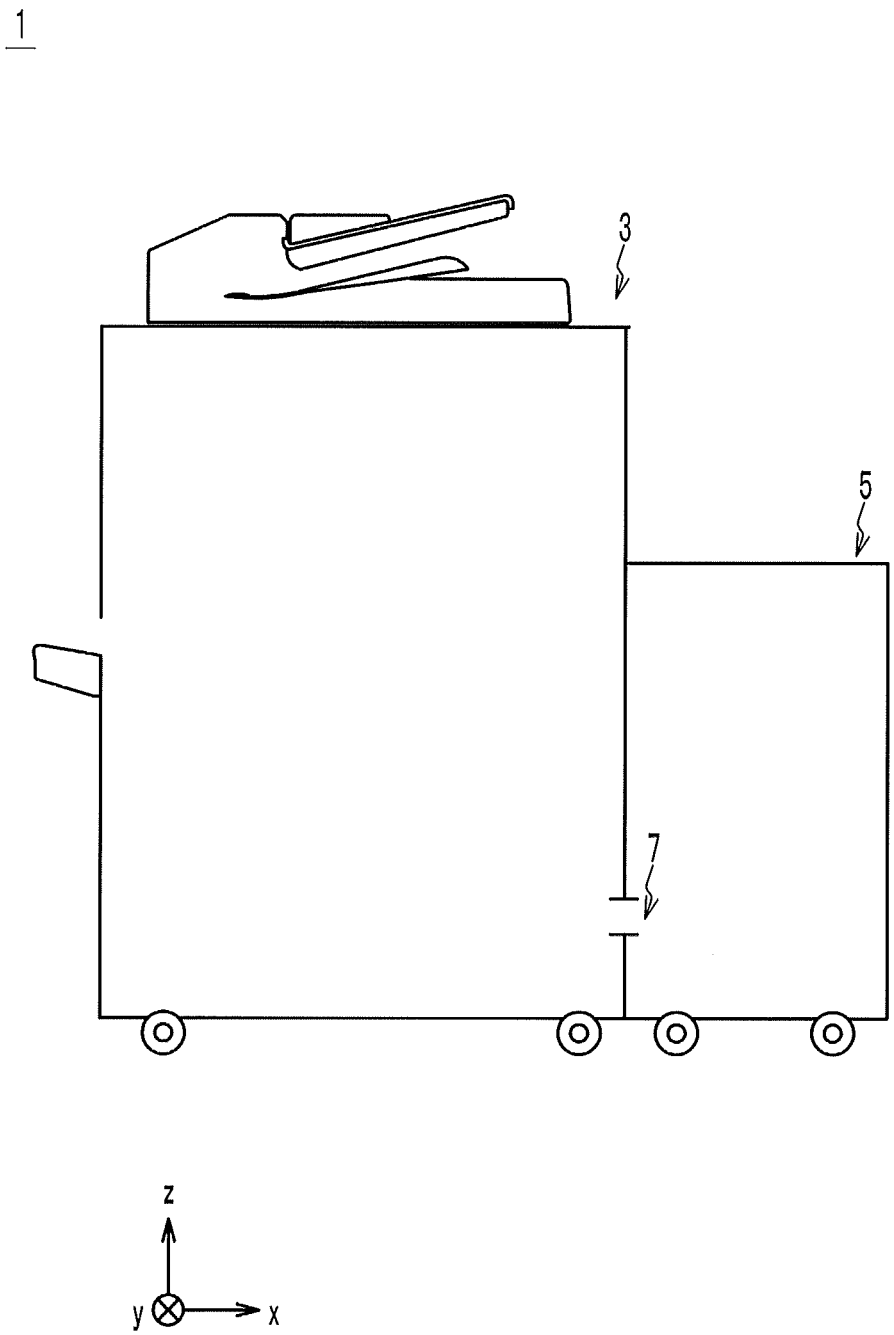
FIG. 1 is a diagram illustrating the configuration of an image forming apparatus including a sheet feeding device according to an embodiment.

Hereinafter, an image forming apparatus including a sheet feeding device according to an embodiment of the present invention will be described with reference to the drawings.

Preliminary Notes

First, the x-, y-, and z-axes in the drawings will be defined. For convenience of explanation, it is assumed in the present embodiment that the x-, y-, and z-axes correspond to the right-left, front-back, and top-bottom directions, respectively, of each of the sheet feeding device and the image forming apparatus. Some components in the drawings have the suffix a, b, c, or d added to the right of their reference numerals. The suffixes a, b, c, and d refer to yellow (Y), magenta (M), cyan (C), and black (Bk), respectively. For example, an imaging portion 27*a*, means an imaging portion 27 for yellow. In addition, reference numerals without suffixes mean any of the colors Y, M, C, and Bk. For example, an imaging portion 27 means an imaging portion for any one of the colors Y, M, C, and Bk.

Configuration and Operation of Image Forming Apparatus

In FIG. 1, the image forming apparatus 1 includes a main unit 3, along with, for example, a sheet feeding unit 5 optionally added to the main unit 3.

Figure 2:
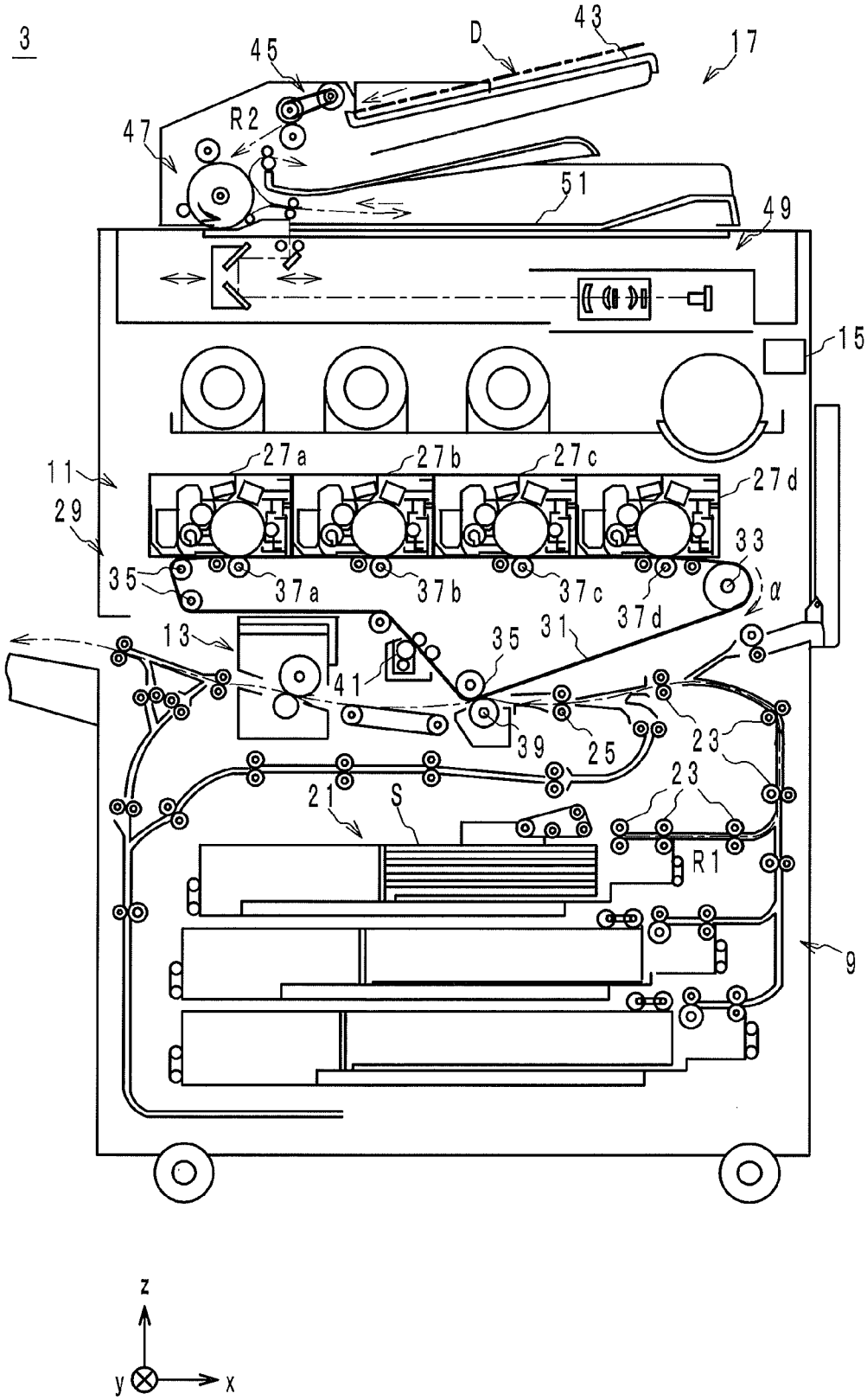
FIG. 2 is a diagram illustrating in detail the configuration of a main unit in FIG. 1.

The main unit 3 is, for example, a multifunction peripheral (MFP), and includes a sheet feeding unit 9, an imaging unit 11, a fusing unit 13, and a control circuit 15, as shown in FIG. 2. Moreover, for example, an image reading unit 17 is optionally added on top of the main unit 3.

The sheet feeding unit 9 generally includes a sheet feeding device 21, a plurality of feed roller pairs 23, and a registration roller pair 25. The sheet feeding device 21 (to be described in detail later) accommodates a plurality of sheets (e.g., paper) placed therein as a stack of sheets S. The sheet feeding device 21 pneumatically floats the top sheet to be picked up from the stack of sheets S, and feeds the sheet into a first transportation path R1 (indicated by a long dashed short dashed line). The fed sheet is transported downstream by the feed roller pair 23 being rotated. Thereafter, the sheet contacts the registration roller pair 25 at rest, and stops there temporarily. The registration roller pair 25 is then rotated by a drive force from a motor (not shown) under timing control by a CPU in the control circuit 15. As a result, the sheet is fed from the registration roller pair 25 toward a secondary transfer region to be described later, with the timing that allows a composite toner image formed on an intermediate transfer belt 31, which will be described later, to be transferred onto a predetermined region of the sheet.

The imaging unit 11 forms an image by means of electrophotography. In addition, in the present embodiment, the imaging unit 11 forms a full-color image. Accordingly, the imaging unit 11 has a tandem configuration, for example. More specifically, the imaging unit 11 consists of, for example, imaging portions 27*a*, to 27*d*, for Y, M, C, and Bk, and a transfer portion 29.

Each of the imaging portions 27*a*, to 27*d*, has a photoreceptor drum rotatably attached thereto. There are a charging unit, an exposing unit, a developing unit, and a cleaning unit provided around the photoreceptor drum.

The charging unit charges the circumferential surface of the photoreceptor drum for its corresponding color.

The exposing unit receives image data for the corresponding color. Here, the image data is initially transmitted to the CPU in the control circuit 15 from a personal computer connected to the main unit 3 or the image reading unit 17 to be described later. The CPU generates image data for each of the colors Y, M, C, and Bk, on the basis of the received image data, and outputs the generated data to the exposing units corresponding to the colors. The exposing unit generates an optical beam modulated with the image data for its corresponding color, and scans line by line the circumferential surface of the photoreceptor drum being charged. Since the photoreceptor drum is rotating, an electrostatic latent image in the corresponding color is formed on the circumferential surface thereof.

The developing unit develops the electrostatic latent image formed on the photoreceptor drum for the corresponding color, by toner, thereby forming a toner image in the color on the circumference surface of the photoreceptor drum.

The transfer portion 29 generally includes the intermediate transfer belt 31 in an endless form, a drive roller 33, a plurality of driven rollers 35, primary transfer rollers 37*a*, to 37*d*,, a secondary transfer roller 39, and a cleaning unit 41.

The intermediate transfer belt 31 is stretched around the drive roller 33 and the driven rollers 35. The drive roller 33 is rotated by a drive force provided by an unillustrated motor. The driven rollers 35 are rotated following the rotation of the drive roller 33. As a result, the intermediate transfer belt 31 rotates in the direction indicated by arrow $\alpha$.

The primary transfer rollers 37 have transfer voltages applied thereto. Electric fields are generated between the primary transfer rollers 37 and the photoreceptor drums for their corresponding colors. Toner images supported on the photoreceptor drums are transferred (primary transfer) sequentially onto the same area of the intermediate transfer belt 31 by action of the electric fields. As a result, the transferred toner images in their respective colors overlap with one another, forming a composite toner image on the intermediate transfer belt 31. The composite toner image is carried toward the secondary transfer roller 39 through rotation of the intermediate transfer belt 31.

The secondary transfer roller 39 is in contact with the intermediate transfer belt 31, forming a secondary transfer region therebetween. A sheet fed from the registration roller pair 25 is introduced into the secondary transfer region. The secondary transfer roller 39 has a transfer voltage applied thereto, and therefore, an electric field is generated between the secondary transfer roller 39 and the intermediate transfer belt 31. By action of the electric field, the sheet passing through the secondary transfer region is subjected to secondary transfer of the composite toner image from the intermediate transfer belt 31. The secondary transfer roller 39 and the intermediate transfer belt 31 feed the sheet subjected to the secondary transfer, downstream in the first transportation path R1.

Incidentally, the toner that is left untransferred onto the intermediate transfer belt 31 after primary transfer remains on the circumferential surface of each photoreceptor drum as untransferred toner. The cleaning unit in each imaging portion 27 collects untransferred toner by scraping it off the circumferential surface of the photoreceptor drum for the corresponding color.

Furthermore, the toner that is left untransferred after secondary transfer remains on the surface of the intermediate transfer belt 31 as untransferred toner. The cleaning unit 41 collects untransferred toner by scraping it off the intermediate transfer belt 31.

The fusing unit 13 includes a heating roller and a pressure roller, which forms a fusing nip. The sheet from the secondary transfer region is introduced to the fusing nip. The sheet is heated and pressed while it is passed through the fusing nip by rotation of the rollers. As a result, the composite toner image is fixed on the sheet. Thereafter, the fusing unit 13 feeds the sheet toward an ejection roller pair provided downstream in the first transportation path R1.

Once the sheet subjected to the fusing processing is introduced from the fusing unit 13, the ejection roller pair ejects the sheet into an output tray outside the main unit.

The foregoing has been provided with respect to the process for forming a full-color image, but if a monochrome image is formed, typically, only the imaging portion 27*d*, for Bk is driven.

As described above, the main unit 3 has the image reading unit 17 attached thereto. The image reading unit 17 is also called an automatic document feeder (ADF), and generally includes a feed tray 43, a feeding portion 45, a registration roller pair 47, a document reading portion 49, and an output tray 51.

The feed tray 43 is structured such that documents D to be read can be placed therein. The feeding portion 45 feeds documents D one by one from the feed tray 43 into a second transportation path R2 (see an arrow in FIG. 2).

The registration roller pair 47 forms a registration nip. The registration roller pair 47 is initially at rest, and therefore, the sheet fed into the second transportation path R2 by the feeding portion 45 stops temporarily upon contact with the registration nip. Thereafter, the registration roller pair 47 is rotated in accordance with timing control by the CPU in the control circuit 15, thereby transporting the document D fed into the second transportation path R2 by the feeding portion 45, further to a reading position. After passing the reading position, the document D is ejected into the output tray 51.

The document reading portion 49 is fixed immediately below the reading position, to read the document D passing through the reading position, in line-by-line sequence, and generate image data. The image data is typically outputted to the CPU, which will be described below.

Furthermore, the control circuit 15 consists at least of flash memory, the CPU, and main memory. The CPU executes a program, which is stored in, for example, the flash memory, in the main memory to control various components (including the image reading unit 17 and the sheet feeding unit 5).

Figure 3:
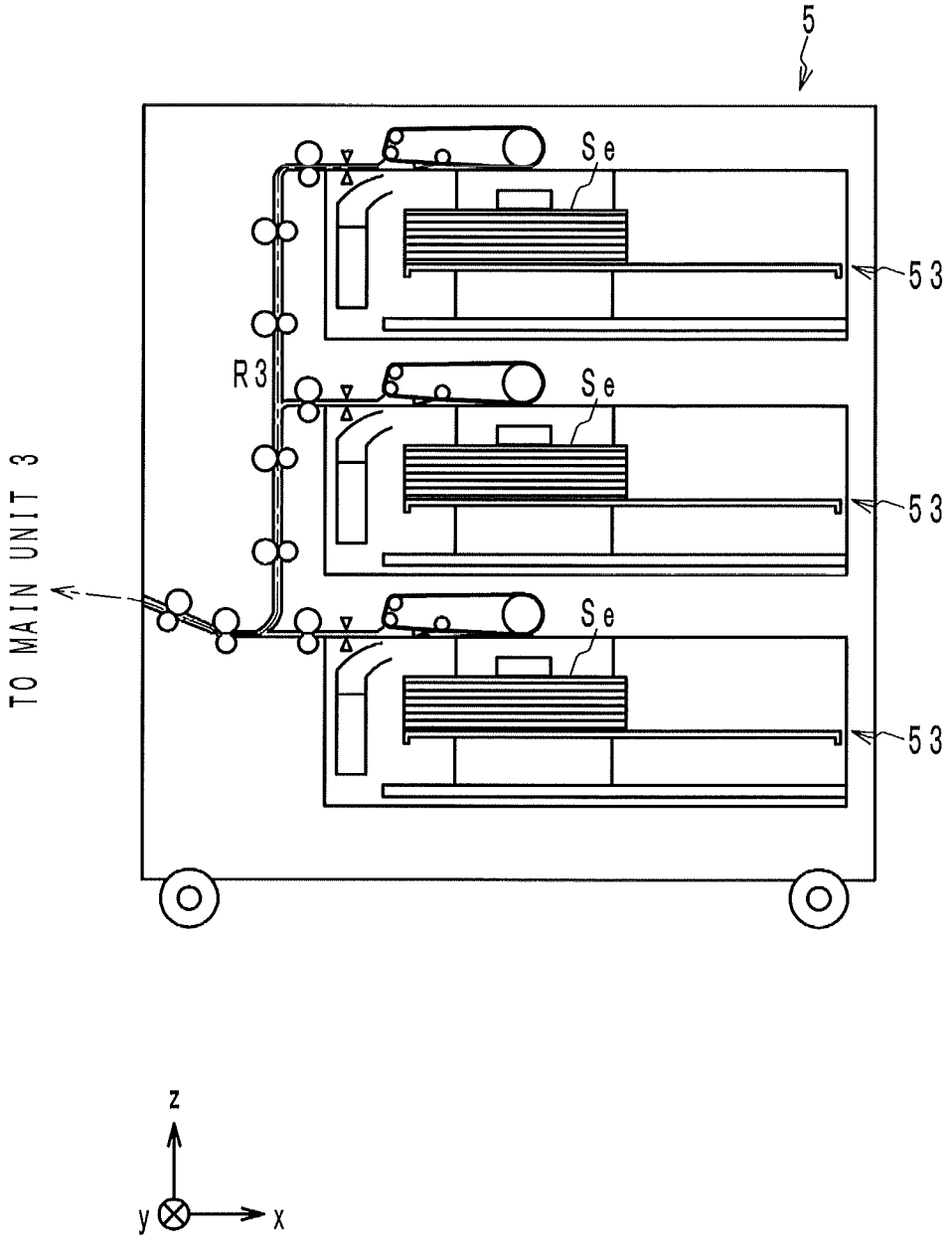
FIG. 3 is a diagram illustrating in detail the configuration of feeding units in FIG. 1.

As described above, the image forming apparatus 1 includes the sheet feeding unit 5. The sheet feeding unit 5 is disposed adjacently to the right of the main unit 3, as illustrated in FIG. 1. The sheet feeding unit 5 includes a plurality of vertically arranged sheet feeding devices 53, as shown in FIG. 3.

Furthermore, each of the sheet feeding devices 53 has the same configuration as the sheet feeding device 21 (to be described in detail later), and accommodates a plurality of sheets (e.g., paper) placed therein as a stack of sheets Se. The sheet feeding device 53 (to be described in detail later) pneumatically floats the top sheet to be picked up from the stack of sheets Se, and feeds the sheet into a third transportation path R3 (indicated by a long dashed short dashed line). The fed sheet is transported through the third transportation path R3, and thereafter, passes through a communicating slit 7 (see FIG. 1) into the main unit 3. The main unit 3 is provided with a transportation path (not shown) through which the sheet fed from the sheet feeding device 53 is transported to the registration roller pair 25. Accordingly, an image is formed on the sheet as well in the same manner as described above.

Configuration and Operation of Sheet Feeding Device

Next, the configuration of the sheet feeding device 53 will be described with reference to FIGS. 4 to 6. Note that the sheet feeding device 21 has the same configuration as the sheet feeding device 53, as described above, and therefore, any description thereof will be omitted.

The sheet feeding device 53 includes an elevating plate 55, an abutting portion 57, a limit sensor 59, a suction/transportation mechanism 61, a transportation roller pair 63, a feed sensor 65, first blowing mechanisms 67, a second blowing mechanism 69, and a suction sensor 70.

The elevating plate 55 has a rectangular mounting portion 71 approximately parallel to the xy plane. The normal direction to the mounting portion 71 will be referred to below as the stacking direction z. The mounting portion 71 accommodates a plurality of sheets piled in the stacking direction therein as a stack of sheets Se. The elevating plate 55 is configured so as to be movable up and down along the stacking direction z between predetermined lower and upper limit positions. As for the elevating mechanism, a well-known technology can be applied, and therefore, any description thereof will be omitted.

The abutting portion 57 has an abutting face 73. The abutting face 73 extends in a direction parallel to the stacking direction z, from a position along one of the four sides of the mounting portion 71 that is located on the negative side of the x-axis. The abutting face 73 contacts one of the four sides of the stack of sheets Se that is located on the negative side of the x-axis (i.e., the left side of the stack). Note that each sheet is fed into the third transportation path R3 from one of the two sides parallel to the y-axis that is located on the negative side of the x-axis. Therefore, the left side of the stack of sheets Se will also be referred to below as the front side of the stack of sheets Se, and the left side of the sheet will also be referred to below as the front side of the sheet.

Note that the following are provided around the mounting portion 71, but they are not essential to the present invention, and therefore, the details thereof will not be described: a pair of regulating plates that regulate the position of the stack of sheets Se in the y-axis direction; and a regulating plate that regulates the right-side position of the stack of sheets Se in the x-axis direction such that the left side of the stack contacts the abutting face 73.

The limit sensor 59 is typically an active optical sensor fixed to the abutting portion 57. For example, the limit sensor 59 outputs an electrical signal indicative of Hi to the control circuit 15 (to be described later) if the top sheet of the stack of sheets Se reaches the predetermined upper limit position. On the other hand, if the predetermined upper limit position is not reached, an electrical signal indicative of Lo is outputted.

The suction/transportation mechanism 61 is provided above the elevating plate 55 and the abutting portion 57, and specifically includes, for example, two suction belts 74, a chamber 79, a drive roller 75, and for example, three driven rollers 77.

Each of the suction belts 74 is an endless belt. Each belt 74 has a number of holes piercing from the outer surface to the inner surface. More specifically, a predetermined number of through-holes (namely, arrays of through-holes) are provided along the width direction of each belt 74 (i.e., the direction parallel to the y-axis). The arrays of through-holes are bored at predetermined intervals across the entire length of the belt.

The chamber 79 is provided inside relative to the suction belts 74, and generally consists of an air inlet, a fan, and a motor. The air inlet is provided so as to face the inner surfaces of the suction belts 74 that extend therebelow. The fan is housed in the chamber and rotated by a drive force provided by the motor. Accordingly, air between the suction belts 74 and the stack of sheets Se is taken into the chamber 79 from the through-holes in the suction belts 74, so that the top sheet floated by the first blowing mechanisms 67, etc., as will be described later, is attracted to the bottom surfaces of the suction belts 74 (i.e., suction surfaces).

For example, the drive roller 75, when viewed in a plan view in the y-axis direction, is positioned above the center of the mounted stack of sheets Se in the x-axis direction. Moreover, two of the three driven rollers 77 are arranged side by side approximately in the vertical direction above the second blowing mechanism 69. These rollers 77 are positioned offset from each other in the x-axis direction on the negative side relative to the abutting face 73. In addition, the remaining driven roller 77 (also referred to below as the intermediate driven roller) is positioned between the lower driven roller 77 (also referred to below as the left driven roller) and the drive roller 75.

Each of the rollers 75 and 77 has a rotation axis approximately parallel to the y-axis. The drive roller 75 is rotationally driven by a drive force from an unillustrated motor. Once the drive roller 75 starts rotating, each of the driven rollers 77 is rotated correspondingly.

The two suction belts 74 are stretched around the rollers 75 and 77, so as to be positioned side by side in the y-axis direction. More specifically, the drive roller 75 and the intermediate driven roller 77 are arranged with their bottoms approximately at the same position in the z-axis direction. Moreover, the intermediate driven roller 77 and the left driven roller 77 are arranged such that the bottom position of the intermediate driven roller 77 is slightly higher than the bottom position of the intermediate driven roller 77. As a result, each of the suction belts 74 is positioned approximately parallel to the xy plane between the drive roller 75 and the intermediate driven roller 77, and inclined diagonally upward relative to the xy plane between the intermediate driven roller 77 and the left driven roller 77. In other words, each suction belt 74 is curved at the intermediate driven roller 77. The suction belts 74 as above rotate clockwise in accordance with the rotation of the drive roller 75. Thus, the top sheet attracted to the suction surfaces of the suction belts 74 is transported in the direction toward the negative end of the x-axis (i.e., in the transportation direction).

Figure 4:
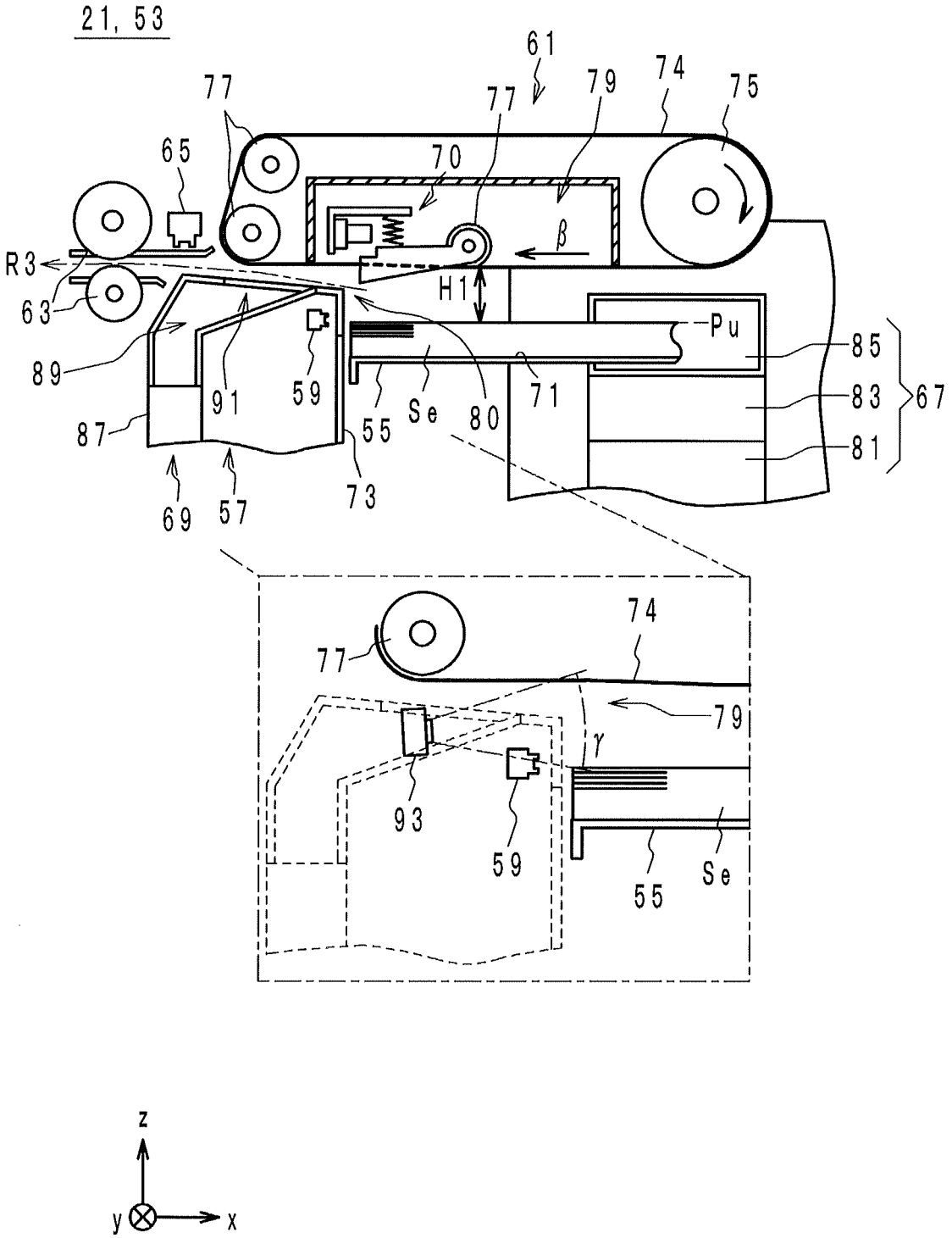
FIG. 4 is a cross-sectional view of the sheet feeding device taken along the ZX plane of FIG. 3 as viewed from the front side.
Figure 5:
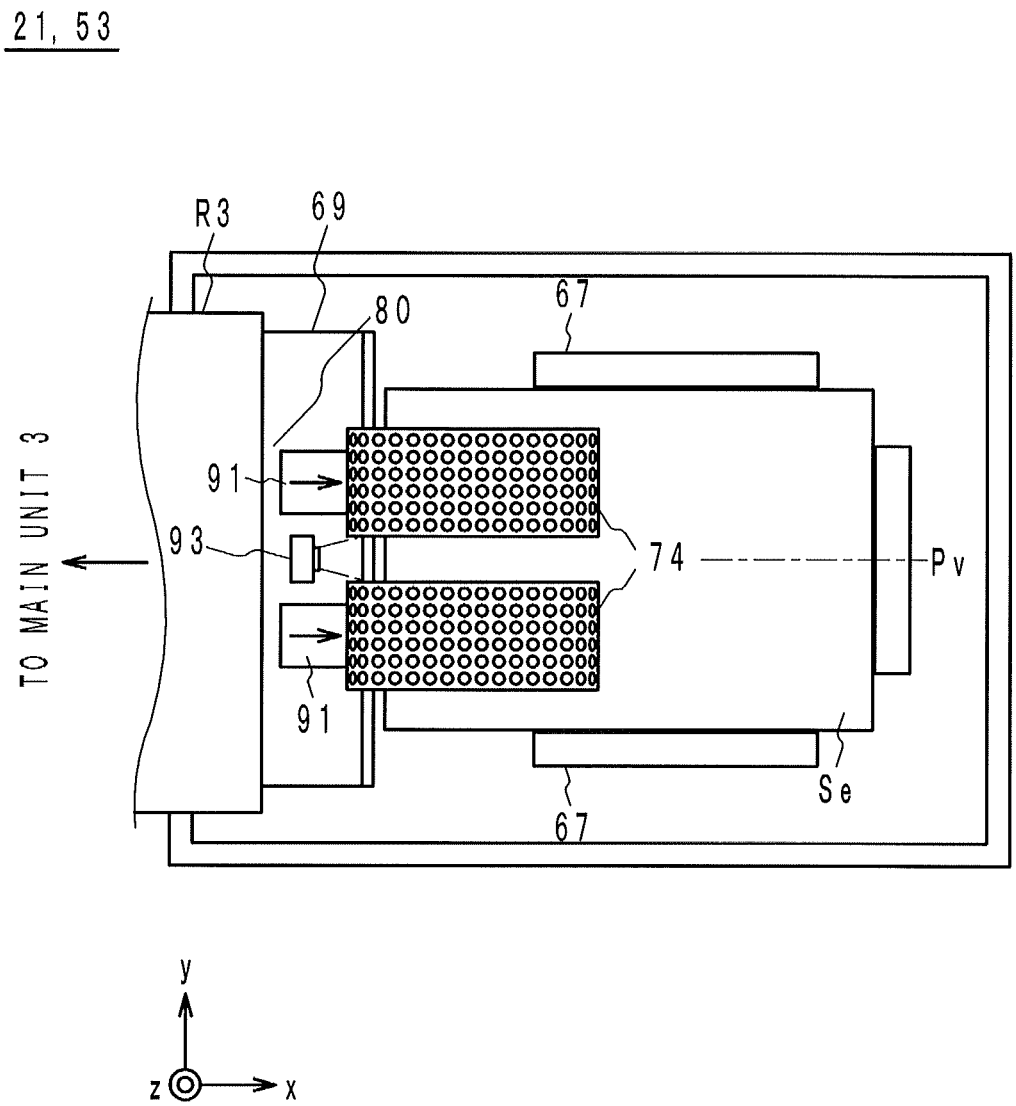
FIG. 5 is a cross-sectional view of the sheet feeding device taken along the YX plane of FIG. 3 as viewed from the right side.
Figure 6:
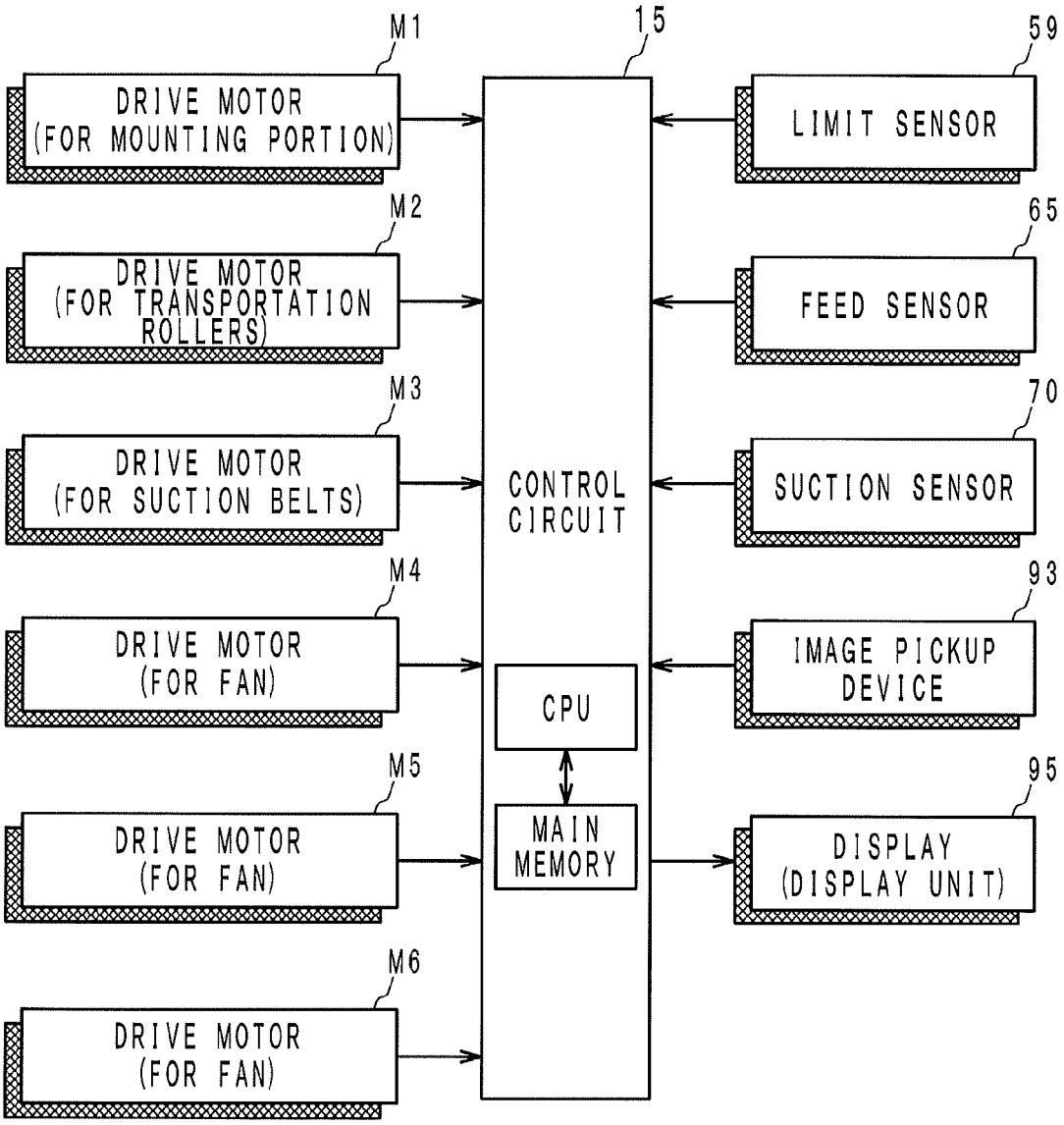
FIG. 6 is a block diagram illustrating a control system of the sheet feeding device in FIG. 3.

FIGS. 4 and 5 show the beginning of the third transportation path R3. The third transportation path R3 generally consists of a plurality of guiding members. The beginning of the third transportation path R3 is a sheet entrance 80. The entrance 80 is the space between the top edge of the abutting portion 57 and the bottom of the left driven roller 77.

The transportation roller pair 63 is provided near the entrance 80 in the third transportation path R3. The transportation roller pair 63 is rotated by a drive force provided by a motor (not shown), to receive a sheet introduced therebetween and feed it downstream in the third transportation path R3.

Here, the feed sensor 65 is typically an active optical sensor provided between the entrance 80 and the transportation roller pair 63 in the third transportation path R3. The feed sensor 65 outputs to the control circuit 15 an electrical signal indicative of Hi or Lo, by which to specify whether or not a sheet has passed a reference position between the entrance 80 and the transportation roller pair 63.

The first blowing mechanisms 67 are provided one each on the front and back sides of the image forming apparatus 1 relative to the elevating plate 55. Each of the first blowing mechanisms 67 typically includes a fan 81, a duct 83, and an air outlet 85.

The fan 81 takes ambient air into the duct 83. In the first blowing mechanism 67 on the front side, the duct 83 has the air outlet 85 provided near the top of the stack of sheets Se so as to face the foremost side of the stack. In the first blowing mechanism 67 on the front side, air taken into the duct 83 flows through the duct 83 toward the air outlet 85, and is blown out from the air outlet 85 toward the stack of sheets Se at the upper portion of its front side.

On the other hand, the first blowing mechanism 67 on the back side is substantially symmetrical to the one on the front side relative to the center plane Pv (see FIG. 5) of the mounting portion 71 in the y-axis direction. Accordingly, from the air outlet 85 on the back side, air is blown out toward the stack of sheets Se at the upper portion of its back side. More specifically, the front and back sides of the stack of sheets Se herein refer to the side surfaces of the stack that are parallel to both the transportation direction x of the top sheet and the sheet stacking direction z.

The air blown out from both of the air outlets is directed onto the front and back sides of the stack of sheets Se. The air mainly plays the role of floating the top sheet of the stack of sheets Se.

Furthermore, the second blowing mechanism 69 is typically provided on the negative side of the x-axis relative to the mounting portion 71. More specifically, the second blowing mechanism 69 is adjacent to the abutting portion 57 on the negative side of the x-axis. The second blowing mechanism 69 typically includes a fan 87, a duct 89, and, for example, two air outlets 91.

The fan 87 takes its surrounding air into the duct 89. The duct 89 is provided so as to reach the proximity of the entrance 80 of the third transportation path R3. The duct 89 branches two ways at some point such that one air outlet 91 is provided at the end of each branch. In the present embodiment, the two air outlets 91 are spaced apart from each other in the y-axis direction, as shown in FIG. 5. More specifically, the air outlets 91, which are located on the front and back sides, respectively, are provided so as to face the space below the suction belts 74 on the front and back sides, respectively. The air taken into the duct 89 flows toward the two air outlets 91, and is blown out from each of the air outlets 91 toward the positive side of the x-axis. As a result, the air from the air outlets 91 is blown toward a position directly below the corresponding suction belts 74. The air mainly plays the role of separating the top sheet from the next sheet therebelow.

The suction sensor 70 includes at least an active optical sensor and a sensing element, and outputs to the control circuit 15 an electrical signal indicative of Hi or Lo, by which to specify whether or not the top sheet of the stack of sheets Se is being attracted to the suction belts 74.

The sheet feeding device 53 further includes an image pickup device (i.e., camera) 93. As shown in FIG. 5, the image pickup device 93 is positioned so as not to block flows of air blown out from the two air outlets 91 (see arrows). In the present embodiment, by way of example, the image pickup device 93, when viewed in a plan view in the z-axis direction, is provided between the two air outlets 91.

More specifically, the image pickup device 93 faces space γ (see the part enclosed by long dashed short dashed lines in FIG. 4) between the suction belts 74 and the foremost edge of the top sheet (i.e., the edge being parallel to the y-axis and located on the negative side of the x-axis), such that space γ can be seen through. Here, the wording "seen through" is intended to mean that there is nothing between the lens of the image pickup device 93 and space γ that blocks the field of view of the image pickup device 93. In addition, the term "to face" encompasses the case where the lens of the image pickup device 93 is straight in front of space γ in the x-axis direction, and also encompasses the case where the image pickup device 93 faces space γ from a position diagonally therebelow with respect to the xy plane.

Typically, the image pickup device 93 as above captures images of the foremost edge of the floated top sheet and the foremost edge of the next sheet therebelow, and outputs data for the images to the control circuit 15 (to be described later).

To capture images of the foremost edge of the floated top sheet and the foremost edge of the next sheet therebelow, as described above, the image pickup device 93 is preferably capable of capturing an image of the suction surfaces of the suction belts 74 if the top sheet is not being attracted to the suction belts 74. In addition, the optical axis of the image pickup device 93 is preferably close to at least the air outlets 91 of the second blowing mechanism 69 and the suction surfaces of the suction belts 74 at their positions in the z-axis direction (i.e., in the stacking direction).

Next, referring to FIG. 6, the control system of the sheet feeding device 53 will be described in detail. The sheet feeding device 53, under control of the CPU, pneumatically floats the top sheet to be picked up from the stack of sheets Se, and feeds the sheet into the third transportation path R3. To perform such control, various components indispensable to the sheet feeding device 53 are electrically connected to the CPU, etc., included in the control circuit 15 of the main unit 3. More specifically, the control circuit 15 is configured so as to be able to receive electrical signals from the limit sensor 59, the feed sensor 65, and the suction sensor 70. Moreover, the control circuit 15 is configured so as to be able to receive image data from the image pickup device 93.

Furthermore, the control circuit 15 is configured so as to be able to transmit control signals to a drive motor M1 for the mounting portion 71, a drive motor M2 for the transportation roller pair 63, a drive motor M3 for the suction belts 74, a drive motor M4 for the fan 81, a drive motor M5 for the fan 87, and a drive motor M6 for the fan in the chamber 79. In addition, the control circuit 15 is connected to a display 95 capable of presenting various types of information. The display 95 is typically a display provided in, for example, the main unit 3.

The control circuit 15 has some information prestored in its flash memory or suchlike, regarding the size and grammage of sheet (i.e., the type of sheet), and the initial value for the amount of air suitable for the type of sheet. To achieve the initial value, the control circuit 15 adjusts the amount of air blown out from each of the first blowing mechanisms 67 and/or the amount of air blown out from the second blowing mechanism 69 by controlling the rotation of the drive motors M4 and M5. The control circuit 15 also controls the rotation of the drive motor M6 in the chamber 79.

The suction sensor 70 outputs an electrical signal to the control circuit 15 to indicate whether or not the top sheet is being attracted to the suction belts 74. The control circuit 15 controls the rotation of the drive motor M3 in accordance with the electrical signal obtained from the suction sensor 70.

The feed sensor 65 outputs an electrical signal to the control circuit 15 to indicate whether or not a sheet fed into the third transportation path R3 has already passed the reference position (as described earlier). The control circuit 15 controls the rotation of the drive motor M2 in accordance with the electrical signal obtained from the feed sensor 65.

The limit sensor 59 outputs an electrical signal to the control circuit 15 to indicate whether or not the top position Pu of the stack of sheets Se is at a predetermined height, i.e., whether or not the top sheet is positioned high enough to be attracted to the suction belts 74. The control circuit 15 keeps the top position Pu at the predetermined height by controlling the rotation of the drive motor M1 in accordance with the electrical signal obtained from the limit sensor 59.

The image pickup device 93 captures an image of the space between the floated top sheet and the next sheet therebelow, and generates data for the image, which is outputted to the control circuit 15. Upon reception of the image data, the control circuit 15 subjects it to predetermined image processing, and calculates the gap between the two sheets. Here, in an example of the image processing method, the number of pixels between the top sheet and the next sheet in the image data is counted, as described in, for example, Japanese Patent Laid-Open Publication No. 2010-254462. In another method, the (foremost) edges of the top sheet and the next sheet are detected by a well-known feature detection process, and the distance between the edges is calculated.

The control circuit 15 controls the rotation of the drive motors M4 and M5 on the basis of the calculated gap, thereby adjusting the amount of air blown out from each of the first blowing mechanisms 67 and/or the amount of air blown out from the second blowing mechanism 69.

Furthermore, the control circuit 15 causes the display 95 to present the image data obtained from the image pickup device 93 or information that represents the gap calculated by the control circuit 15. Here, the information to be presented may be the value for the gap as is or may be textual information that indicates the degree of the gap, such as "large", "medium", or "small".

Note that detailed operational examples of the sheet feeding device 53 are described in Japanese Patent Laid-Open Publication No. 2010-254462,, but they are not relevant to the essence of the present invention, and therefore, no further descriptions will be given herein.

Actions and Effects

Figure 7A:
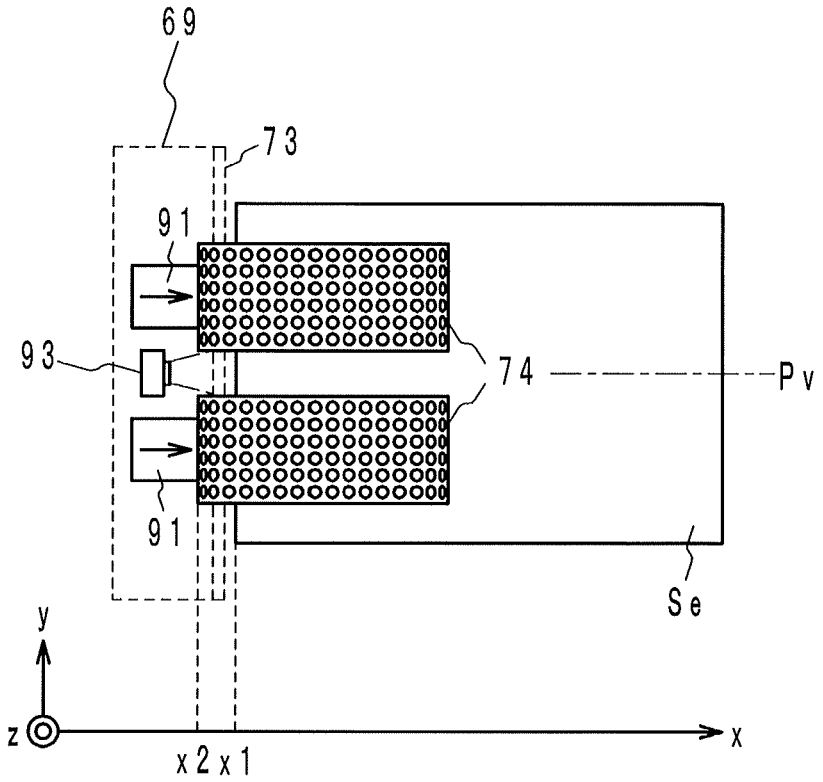
FIG. 7A is a first diagram illustrating the positional relationship between suction belts and a stack of sheets in the sheet feeding device of FIG. 3.
Figure 7B:
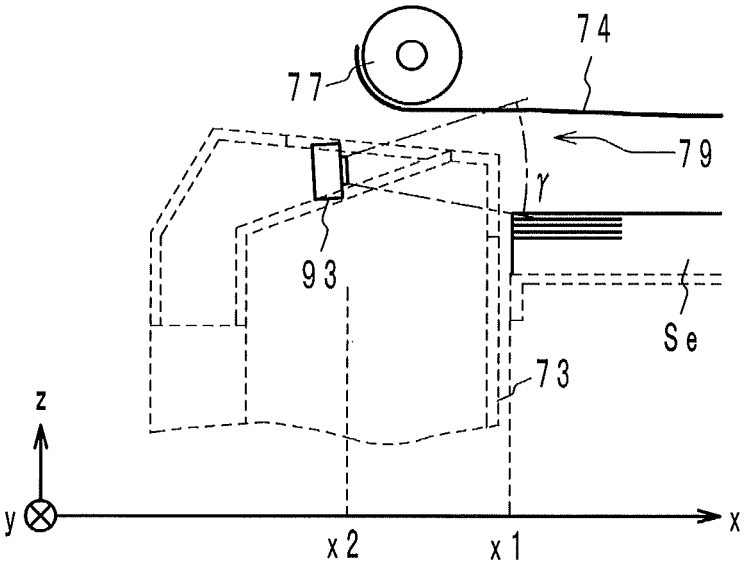
FIG. 7B is a second diagram illustrating the positional relationship between suction belts and a stack of sheets in the sheet feeding device of FIG. 3.

As described above, in the sheet feeding device 53, the left driven roller 77 is positioned offset from the abutting face 73 toward the negative side of the x-axis, and the suction belts 74 are put on the roller 77, as shown in FIGS. 7A and 7B. Accordingly, an x-axis position x2 at the left end of each suction belt 74 is located on the negative side relative to an x-axis position x1 at the foremost side of the stack of sheets Se. In other words, when viewed in a plan view in the stacking direction z, the foremost edge of the top sheet crosses the suction belts 74. Therefore, the foremost edge of the top sheet is attracted to the suction belts 74 so as not to hang downward.

Moreover, the image pickup device 93 is positioned so as to essentially face such a crossing area (i.e., space γ as mentioned earlier), so that the area can be seen through.

With this arrangement, the image pickup device 93 is capable of capturing images of the top sheet and the next sheet therebelow, straight in front of them, without the foremost edge of the top sheet hanging downward. Therefore, the foremost edge of the top sheet can be prevented from overlapping with the next sheet in image data obtained by the image pickup device 93. By using such image data, the control circuit 15 can calculate the gap between the sheets more accurately.

Furthermore, as described above, the image pickup device 93 is capable of capturing an image of the suction surfaces of the suction belts 74 if the top sheet is not being attracted to the suction belts 74. In addition, the optical axis of the image pickup device 93 is preferably close to at least the air outlets 91 of the second blowing mechanism 69 and the suction surfaces of the suction belts 74 at their positions in the z-axis direction (i.e., in the stacking direction). Accordingly, the image pickup device 93 is positioned approximately opposite to the foremost edges of the top sheet and the next sheet in the x-axis direction, so that the gap between the sheets can be calculated from captured images more readily.

Furthermore, as described above, the image pickup device 93 is provided between the two air outlets 91, so as not to block air from the air outlets 91. Thus, the performance in separating the top sheet from the next sheet can be prevented from being degraded.

Supplementary

Figure 8A:
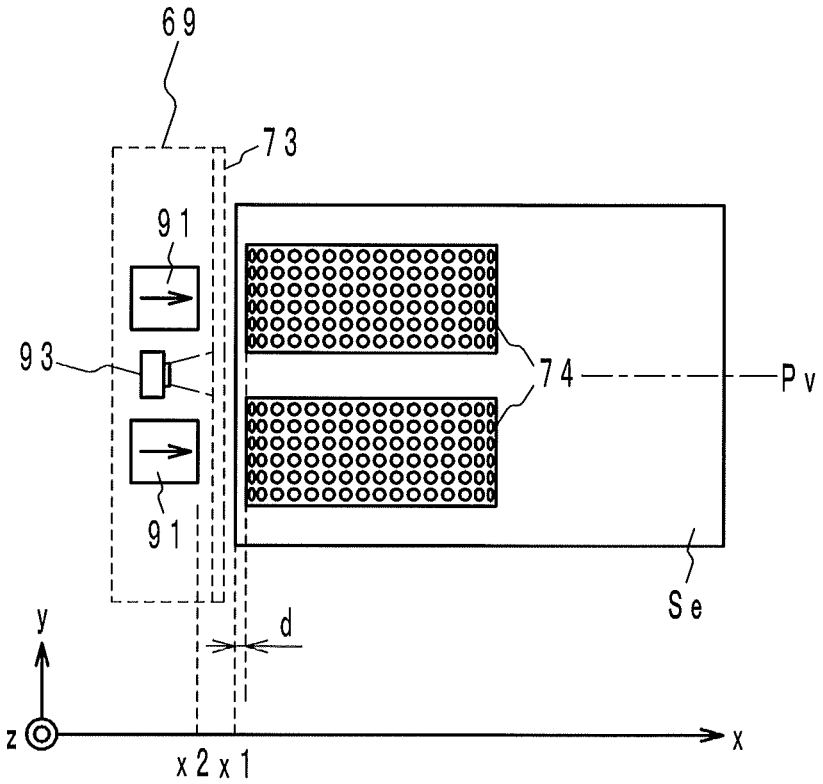
FIG. 8A is a first diagram illustrating the positional relationship between suction belts and a stack of sheets in a sheet feeding device according to a modification.
Figure 8B:
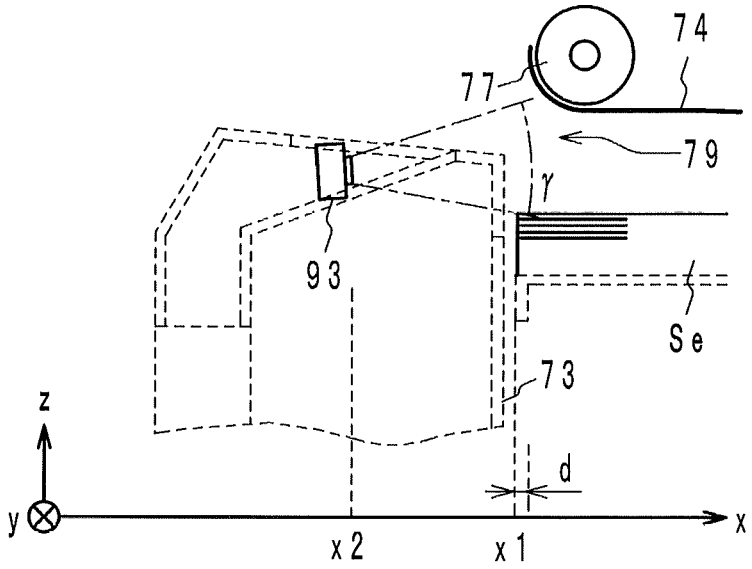
FIG. 8B is a second diagram illustrating the positional relationship between suction belts and a stack of sheets in the sheet feeding device according to the modification.

Note that the above embodiment has been described with respect to the example where the foremost edge of the top sheet crosses the suction belts 74, as shown in FIGS. 7A and 7B. However, this is not limiting, and the foremost edge of the floated top sheet, when viewed in a plan view in the stacking direction z, may contact the end of each suction belt 74 that is located on the negative side in the x-axis direction. Moreover, the foremost edge of the top sheet, when viewed in a plan view in the stacking direction z, may be positioned on the negative side of the x-axis at a predetermined distance d from the end of each suction belt 74 that is located on the negative side in the x-axis direction, as shown in FIGS. 8A and 8B. Here, the predetermined distance d is selected to be close enough for the foremost edge of the top sheet essentially not to sag if the top sheet is being attracted to the suction belts 74. The predetermined distance d is determined in view of various factors, such as the type of sheet and the suction power of the suction/transportation mechanism 61, and therefore, it is preferable that the predetermined distance d be set properly through experimentation.

Configuration Example of Image Pickup Device

Figure 9A:
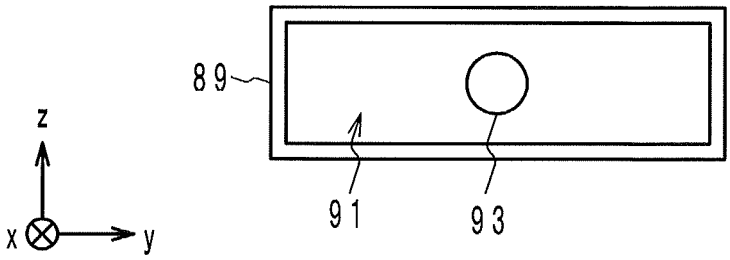
FIG. 9A is a front view of an image pickup device according to a first configuration example.
Figure 9B:
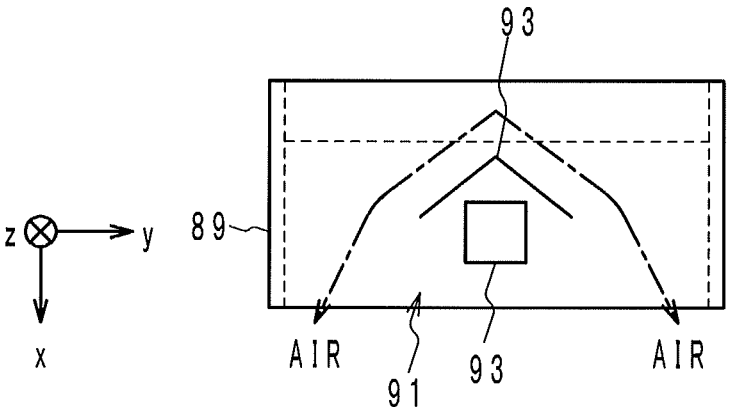
FIG. 9B is a vertical cross-sectional view of the image pickup device in FIG. 9A.

Note that the placement of the image pickup device 93 is not limited by the above embodiment, and the image pickup device 93 may be placed as follows. For example, in the case where the opening area of an air outlet 91 (e.g., a rectangular shape having a width of 20, mm and a length of 50, mm) is significantly larger than the image pickup device 93 (e.g., 10, mm in diameter), the image pickup device 93 may be positioned within the duct 89 near the air outlet 91, as shown in FIG. 9A. Here, it is preferable that an air distributor be provided behind the image pickup device 93 when viewed from the position of the air outlet 91, as shown in FIG. 9B.

Figure 10:
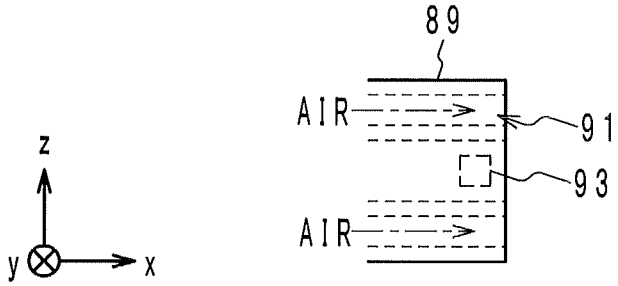
FIG. 10 is a vertical cross-sectional view of an image pickup device according to a second configuration example.

Further, the duct 89 of the second blowing mechanism 69 may consist of, for example, multiple tubes including at least an external tube and an internal tube, as shown in FIG. 10. In this case, the air outlet 91 is provided so as to blow out air from either one of the following two locations: between the external tube and the internal tube or inside the internal tube. Moreover, in such a case, the image pickup device 93 is disposed in the other of the two locations (i.e., in the location where the air outlet 91 is not provided).

Figure 11:
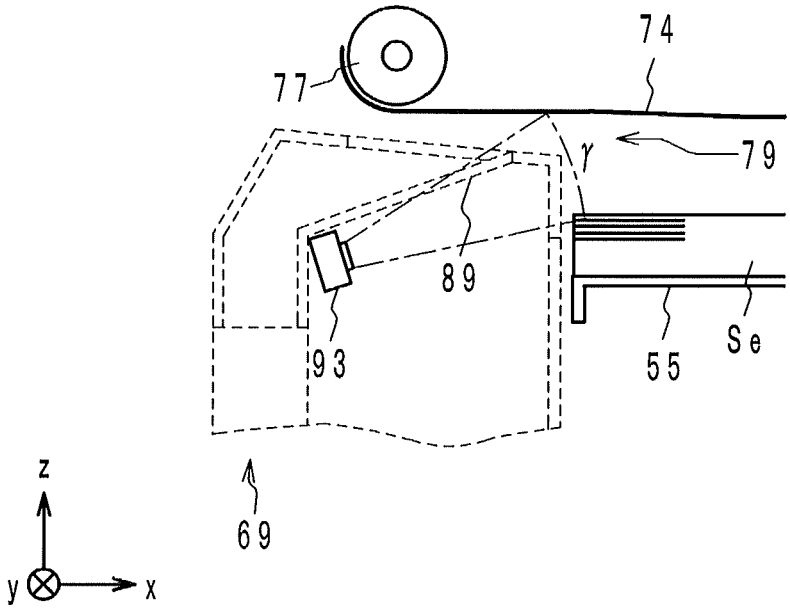
FIG. 11 is a vertical cross-sectional view of an image pickup device according to a third configuration example and its surrounding parts.

Further still, the duct 89 of the second blowing mechanism 69 may be made of, for example, a transparent resin, such as acrylic resin, which has a high light transmittance, as shown in FIG. 11. In this case, the image pickup device 93 is provided outside the duct 89 so as to face space γ between the suction belts 74 and the foremost edge of the top sheet, so that space γ can be seen through.

Figure 12:
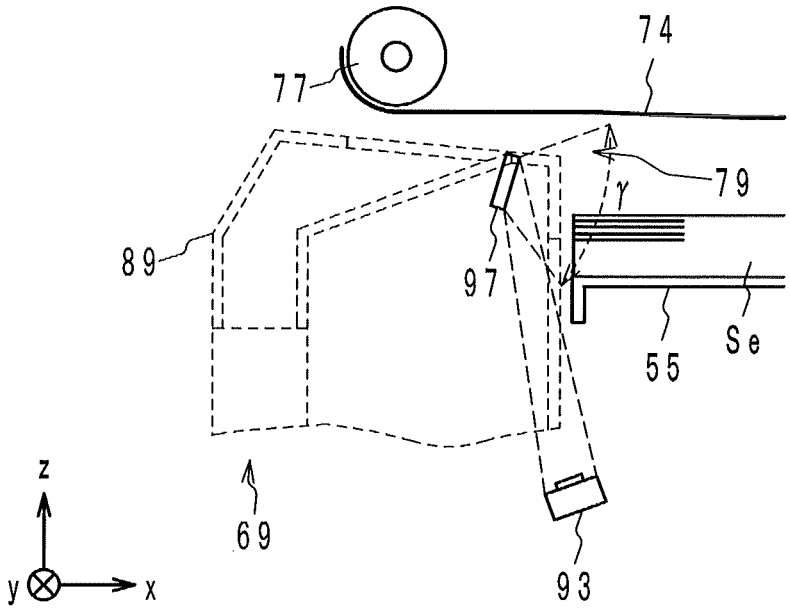
FIG. 12 is a vertical cross-sectional view of an image pickup device according to a fourth configuration example and its surrounding parts.
Figure 13:
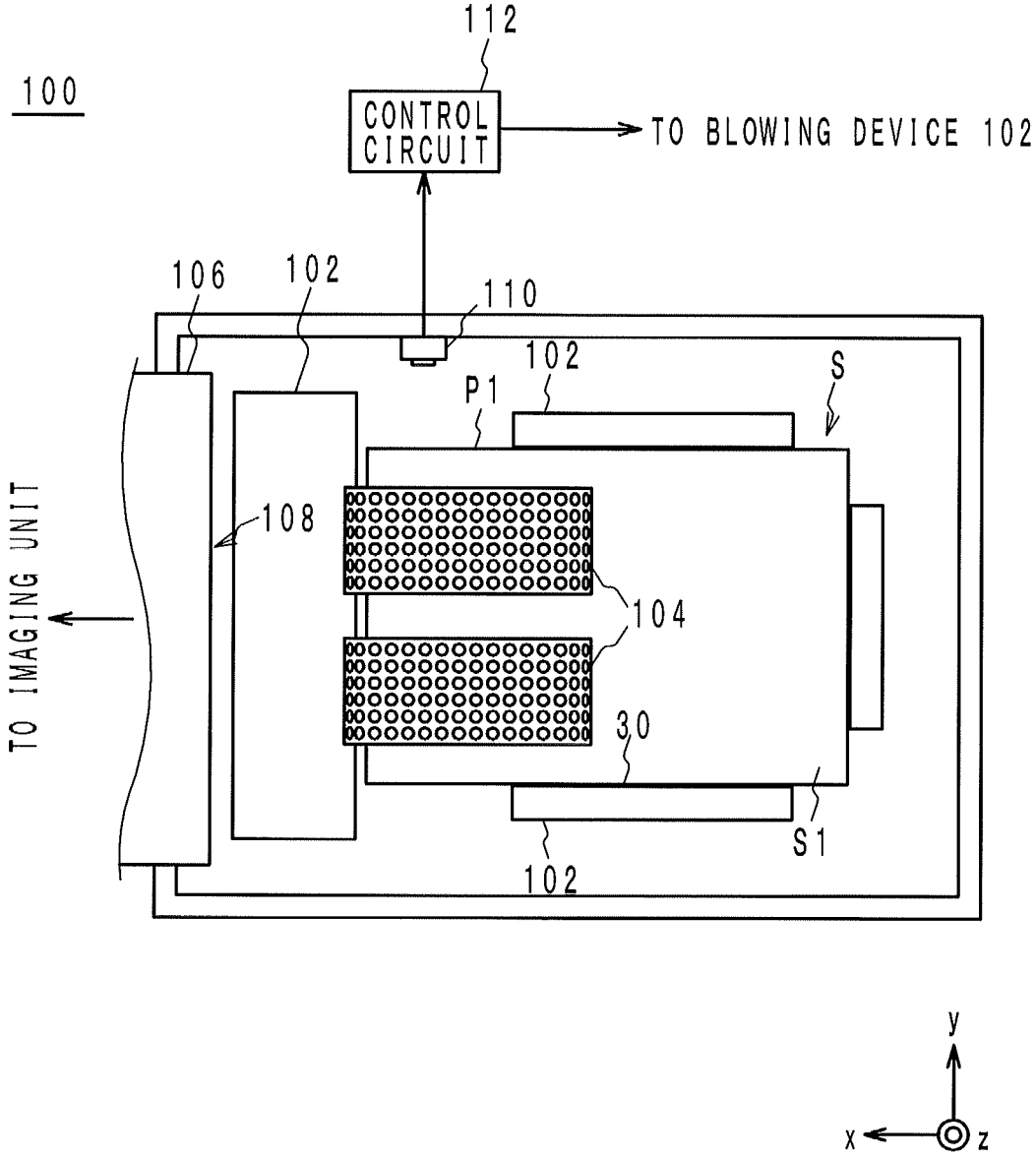
FIG. 13 PRIOR ART
FIG. 13 is a schematic diagram of a conventional sheet feeding device as viewed from above.

Further yet, the image pickup device 93 may be positioned so as to be able to capture an image of the space between the floated top sheet and the next sheet therebelow, via a reflective member (mirror) 97, as shown in FIG. 12. This increases the degree of freedom in placing the image pickup device 93.

Although the present invention has been described in connection with the preferred embodiment above, it is to be noted that various changes and modifications are possible to those who are skilled in the art. Such changes and modifications are to be understood as being within the scope of the invention.

What is claimed is:

1. A sheet feeding device comprising:

a mounting portion capable of accommodating a stack of sheets placed in a predetermined stacking direction;

a blowing device configured to blow air toward the stack of sheets placed in the mounting portion, thereby floating at least a top sheet from the stack;

a suction/transportation mechanism that includes a suction belt provided above the mounting portion and configured to attract the top sheet floated by the blowing device to transport the attracted sheet in a predetermined transportation direction; and an image pickup device configured to capture images of the top sheet and the next sheet therebelow, and disposed so as to see through an area where a side of the top sheet and the suction belt, when viewed in a plan view in the stacking direction, are close to each other during the floating of the top sheet, to such an extent that the side of the top sheet essentially does not hang downward, wherein the images of the top sheet and the next sheet captured by the image pickup device are images of their foremost sides in the transportation direction, and the foremost side of the top sheet essentially does not hang downward.

2. The sheet feeding device according to claim 1, wherein the image pickup device is capable of capturing an image of a suction surface of the suction belt if the top sheet is not being attracted to the suction belt.

3. The sheet feeding device according to claim 1, wherein an optical axis of the image pickup device, an air outlet of the blowing device, and the suction surface of the suction belt are close to one another at their positions in the stacking direction.

4. The sheet feeding device according to claim 1, wherein the image pickup device is disposed so as not to block a flow of air blown onto the stack of sheets by the blowing device.

5. The sheet feeding device according to claim 4, wherein, the blowing device includes a duct in which at least two air outlets are provided so as to be spaced apart from each other, and the image pickup device is positioned between the two air outlets.

6. The sheet feeding device according to claim 4, wherein, the blowing device includes a duct provided with an air outlet and including a transparent member, and the image pickup device is positioned near the transparent member.

7. The sheet feeding device according to claim 1, further comprising a control circuit configured to obtain a gap between the top sheet floated by the blowing device and the next sheet on the basis of images captured by the image pickup device.

8. The sheet feeding device according to claim 7, wherein the control unit configured to control settings of blowing air from the blowing device, on the basis of the obtained gap.

9. The sheet feeding device according to claim 1, wherein the blowing device includes:

a first blowing mechanism configured to blow air toward the stack of sheets placed in the mounting portion, in a first direction; and a second blowing mechanism configured to blow air toward the stack of sheets placed in the mounting portion, in a second direction perpendicular to the first direction.

10. The sheet feeding device according to claim 1, wherein a side of the top sheet and the suction belt, when viewed in a plan view in the stacking direction, are arranged such that during the floating of the top sheet, the foremost side of the sheet in the transportation direction crosses the suction belt.

11. An image forming apparatus comprising a sheet feeding device of claim 1.

12. A sheet feeding device comprising:

a mounting portion capable of accommodating a stack of sheets placed in a predetermined stacking direction;

a blowing device configured to blow air toward the stack of sheets placed in the mounting portion, thereby floating at least a top sheet from the stack;

a suction/transportation mechanism that includes a suction belt provided above the mounting portion and configured to attract the top sheet floated by the blowing device to transport the attracted sheet in a predetermined transportation direction; and an image pickup device configured to capture images of the top sheet and the next sheet therebelow, and disposed so as to see through an area where a side of the top sheet and the suction belt, when viewed in a plan view in the stacking direction, are close to each other during the floating of the top sheet, to such an extent that the side of the top sheet essentially does not hang downward, wherein the image pickup device is disposed so as not to block a flow of air blown onto the stack of sheets by the blowing device, and the blowing device includes a duct in which an air outlet is provided, and the image pickup device is positioned near the air outlet within the duct.

13. A sheet feeding device comprising:

a mounting portion capable of accommodating a stack of sheets placed in a predetermined stacking direction;

a blowing device configured to blow air toward the stack of sheets placed in the mounting portion, thereby floating at least a top sheet from the stack;

a suction/transportation mechanism that includes a suction belt provided above the mounting portion and configured to attract the top sheet floated by the blowing device to transport the attracted sheet in a predetermined transportation direction; and an image pickup device configured to capture images of the top sheet and the next sheet therebelow, and disposed so as to see through an area where a side of the top sheet and the suction belt, when viewed in a plan view in the stacking direction, are close to each other during the floating of the top sheet, to such an extent that the side of the top sheet essentially does not hang downward, wherein the image pickup device is disposed so as not to block a flow of air blown onto the stack of sheets by the blowing device, and the blowing device includes a duct consisting of multiple tubes, including at least an external tube and an internal tube, the duct being configured such that one of two locations, either a space between the external and internal tubes or a space inside the internal tube, is used as an air outlet, and the image pickup device is positioned in the other of the two locations.

14. A sheet feeding device comprising:

a mounting portion capable of accommodating a stack of sheets placed in a predetermined stacking direction;

a blowing device configured to blow air toward the stack of sheets placed in the mounting portion, thereby floating at least a top sheet from the stack;

a suction/transportation mechanism that includes a suction belt provided above the mounting portion and configured to attract the top sheet floated by the blowing device to transport the attracted sheet in a predetermined transportation direction;

an image pickup device configured to capture images of the top sheet and the next sheet therebelow, and disposed so as to see through an area where a side of the top sheet and the suction belt, when viewed in a plan view in the stacking direction, are close to each other during the floating of the top sheet, to such an extent that the side of the top sheet essentially does not hang downward;

a control circuit configured to obtain a gap between the top sheet floated by the blowing device and the next sheet on the basis of images captured by the image pickup device; and a display unit configured to present images captured by the image pickup device and/or information representing the gap obtained by the control circuit.

15. A sheet feeding device comprising:

a mounting portion capable of accommodating a stack of sheets placed in a predetermined stacking direction;

a blowing device configured to blow air toward the stack of sheets placed in the mounting portion, thereby floating at least a top sheet from the stack;

a suction/transportation mechanism that includes a suction belt provided above the mounting portion and configured to attract the top sheet floated by the blowing device to transport the attracted sheet in a predetermined transportation direction;

a reflective member disposed so as to face an area where a side of the top sheet and the suction belt, when viewed in a plan view in the stacking direction, are close to each other during the floating of the top sheet, to such an extent that the side of the top sheet essentially does not hang downward; and an image pickup device configured to capture images of the top sheet and the next sheet therebelow reflected in the reflective member.

16. An image forming apparatus comprising a sheet feeding device of claim 15.

* * * * *